US007569120B2

(12) United States Patent
Bjorkstrom et al.

(10) Patent No.: US 7,569,120 B2
(45) Date of Patent: Aug. 4, 2009

(54) METHOD FOR CONVERTING AN UP-FLOW TOWER FOR CELLULOSE PULP TO A DOWN-FLOW TOWER

(75) Inventors: Jonas Bjorkstrom, Karlstad (SE); Ulf Jansson, Karlstad (SE)

(73) Assignee: GLV Fiance Hungary Kft., Munsbach (LU)

( * ) Notice: Subject to any disclaimer, the term of this patent is extended or adjusted under 35 U.S.C. 154(b) by 237 days.

(21) Appl. No.: 11/301,004

(22) Filed: Dec. 12, 2005

(65) Prior Publication Data

US 2006/0191651 A1 Aug. 31, 2006

(30) Foreign Application Priority Data

Feb. 11, 2005 (SE) ..... 0500326

(51) Int. Cl.
*D21C 1/10* (2006.01)

(52) U.S. Cl. ..... 162/52; 162/17; 162/57; 162/380; 366/190

(58) Field of Classification Search ..... 162/52, 162/57, 58, 59, 51, 380, 189, 190, 191, 264, 162/258; 366/190
See application file for complete search history.

(56) References Cited

U.S. PATENT DOCUMENTS 3,848,016 A * 11/1974 Kono et al. ..... 585/635
5,538,597 A * 7/1996 Koso et al. ..... 162/246
6,098,658 A * 8/2000 Toukonummi ..... 137/592

FOREIGN PATENT DOCUMENTS

EP 0062232 A1 * 3/1982

OTHER PUBLICATIONS

Gullichsen Johan (Editor), Chemical Pulping, 1999, Fapet Oy, p. 623-624.*

* cited by examiner

*Primary Examiner*—Steven P Griffin
*Assistant Examiner*—Anthony J Calandra

(57) ABSTRACT

The method is for converting a vertically standing up-flow tower by inserting a freely insertable pipe into the conical part of the up-flow tower the tower is converted to a down-flow tower where the tower can easily be restored to the up-flow tower and optimized with regards to a minimized stagnation volume in the tower. The upper open end of the pipe is disposed at a first distance (A) from the lower part of the conical inlet part. The first distance (A) is less than the total vertical extension (B) of the conical inlet part. The cellulose pulp establishes a self-forming stagnation zone around the pipe at a lower part of the down-flow tower.

5 Claims, 1 Drawing Sheet

METHOD FOR CONVERTING AN UP-FLOW TOWER FOR CELLULOSE PULP TO A DOWN-FLOW TOWER

PRIOR APPLICATION

This application is a U.S. national phase application claiming priority based on Swedish Patent Application No. 0500326-4, filed 11 Feb. 2005.

FIELD OF INVENTION

The present invention related to a method for converting a tower for storing/treating cellulose pulp of medium consistency and the tower itself.

BACKGROUND OF THE INVENTION

A number of different types of reactors and storage towers for cellulose of medium and/or low consistency are known. The low consistency area, typically at 3-8% pulp consistency, is a much easier application area, since the pulp substantially behaves like a fluid and can more easily be pumped to and from these towers and reactors without a risk for blockage. The medium consistency area, typically at 8-16% pulp consistency, is a much more difficult application area where it is necessary to consider plugging and stoppage of the feeding. Cellulose pulp of 10% consistency can due to the holding together by the fiber network be held in the hand and only after squeezing can the liquid be pressed out. At this consistency the pulp can easily form plugs in inlets and outlets if those are not shaped in the right way.

In, for example, U.S. Pat. No. 5,319,902 a method is shown for converting a down-flow tower, of a mass tower type, from one application for storage of low consistency pulp to an application for storage of medium and/or high consistency pulp. Here a lower bottleneck portion of the mass tower is filled with a filler material (cement or similar material) in which a discharge pipe is mounted in the built-up concave bottom surface. By this design the bottom of the tower is converted so that it obtains a shape that is adapted for a smooth discharge of medium or high consistency pulp without the risk of blockade in the discharge pipe. The solution in U.S. Pat. No. 5,319,902 requires a relatively expensive conversion though where a tower with a more or less permanent curved bottom is obtained. If the tower is to be converted to a low consistency tower of a mass type it is necessary to chisel away the filler of the bottom construction.

In an up-flow tower that holds medium consistency pulp it is necessary to make sure that the flow established through the cross-section of the tower/reactor is always of a similar flow across the whole cross-section so that so called canal formations are not established. Canal formations establish a central flow through the reactor that only uses a fraction of the total volume of the tower/reactor.

With the purpose of establishing an even flow across the cross-section the bottom of the tower may have many inlets so that the inlets evenly distribute the flow across the whole cross-section. An example of such as variant is shown in U.S. Pat. No. 3,992,248 where these inlets are sequentially opened in a predetermined order. An other alternative is a reactor inlet that Kvaerner Pulping AB has sold for decades where a rotating cylinder that extends into the bottom of the reactor has a radially directed inlet in the mantel surface of the cylinder wall so that the pulp flow is radially dispersed over the bottom of the tower under the rotation of the inlet.

Another alternative in order to avoid these distribution arrangements is to form the inlet part of the up-flow tower so that it is conical with a cone angle $\alpha$ relative the horizontal plane in the order of 30-80°, preferably 45-60°. An example of such an up-flow reactor that has a conical inlet is shown in U.S. Pat. No. 5,034,095. Through this conical inlet part the flow from the inlet will be successively distributed across the cross-section. The drawback of these towers is that they are virtually impossible to use a down-flow tower for medium consistency pulp since the conical part provides a substantial plug forming effect for medium consistency pulp that flows down the conical part. If the technique in, for example, U.S. Pat. No. 5,319,902 is used to convert such up-flow towers with a cone shaped inlet it would be necessary to fill almost the entire volume of the conical part with cement. This would reduce the storage capacity of the tower and the tower could not easily be converted to an up-flow tower if so is desired without having to chisel away the filler material of the tower which is a time consuming and expensive procedure.

In U.S. Pat. No. 5,538,597 a solution is shown where cellulose pulp with a higher consistency is withdrawn from a second highly placed outlet opening from a mass tower so that the pulp is diluted to a low consistency at the lower dilution zone of the tower. In the main variants a short inserting tube is used for the second/upper outlet that has such a length that the stationary boundary layer is only passed at the walls of the tower and reaches the formed flow. In this way, pulp of medium consistency can be withdrawn. In a variant shown in FIG. 8 a vertically directed insertion tube was used that according to the directions is inserted into the upper part of the tower i.e. substantially above the dilution zone of the lower part of the tower which according to the figure is shown so that the end of the insertion tube is above the level of the conical conversion part of the mass tower. The purpose of this solution is to provide a possibility to also withdraw pulp of medium consistency while simultaneously withdrawing pulp of low consistency. The formed flow passed the outlets of the pipes is a requirement to be able to pump out medium consistency pulp also (the end of the pipe must reach into " . . . said zone of moving pulp . . . ", see claim 1). By using this solution only a fraction of the volume (and dwell time) of the tower can be used as storage or treatment tower for medium consistency pulp since the main part of the pulp passes the upper pipe and is later discharged as low consistency pulp and where the volume over the insertion pipe is only a smaller portion of the upper part of the tower.

In U.S. Pat. No. 6,371,526 a solution is shown for handling pulp flows of medium consistency in pipes where at the flow transition from large diameter pipes to pipes with smaller diameters a special quick cone is used where the pipe with the small cross-section is inserted into the larger flow cross-section. There is a conical wall connection from the wall of the bigger pipe to the wall of the smaller pipe at the same level as seen in the flow direction after the end of the small pipe. In this way a simpler quick cone (transition from the thicker pipe to thinner pipe) is obtained for medium consistency pulp without the risk for plugging. This solution is mainly intended for simplified quick cones for flows from bigger pipes to pipes with a smaller flow cross-section.

SUMMARY OF THE INVENTION

The present invention intends to provide an improved and simplified method for converting an up-flow tower with a conical inlet part that is intended for storage or treatment of medium consistency cellulose pulp to a storage or treatment tower of a down-flow type.

The main purpose of the invention is with simple means be able to convert a specifically adapted up-flow tower so that it can be used as a storage or treatment tower of a down-flow type. The conversion is mainly done by merely inserting a pipe in the bottom of the tower which pipe can simply be withdrawn when converting the tower back to the original up-flow tower. In many bleach lines for cellulose pulp there are up-flow towers with conical inlet parts in specific processing positions such as reactors for E-, EO- or EOP-steps. Another example is when gaseous bleaching substances are used when the up-flow towers are preferred since the pressure is naturally the highest in the lower inlet part of the tower (where the gaseous bleaching substance has the highest volume portion of the suspension before consumption/reaction).

In connection with the optimization/conversion of bleach lines one or many bleaching steps are omitted which results in that the original towers including accessories, inlet and outlet pipes are superfluous. The alternative is to scrap the towers and the equipment belonging thereto which is a significant waste of capital since storage towers or treatment towers most often are still required to enhance the bleaching process.

Up-flow towers were used in process positions where a predetermined dwell time of the cellulose pulp in a chemical reaction zone is required when the time is a deciding factor for the desired result. These up-flow towers are held hydraulically filled but can not be used as intermediary or buffer towers where it is possible to vary the store pulp volume between different processing steps and where the processing steps not always are in the same flow (such as during startup or adjustment of a processing step). The up-flow towers are normally scrapped if they cannot be converted to down-flow towers since the up-flow towers have a given specific shape to establish a given dwell time of the pulp in the tower. The up-flow towers with a conical inlet part has a purpose of removing the need for distribution arrangements in the lower part of the tower these towers has almost always been scrapped after conversion of the bleach line so that these towers are no longer required.

Another purpose during conversion of the up-flow tower to a down-flow tower is to maximize the total operationally active storage volume of the tower since one simply by pushing up or pulling down the insertion pipe can adjust the stationary stagnation zone so that it is minimized by volume in the tower depending upon the current pulp consistency that is stored/treated in the tower. Such an adaptation and/or adjustment to different consistencies cannot for example be done in the conversion variant shown in U.S. Pat. No. 5,319,902 where cement (which must be used in practice) is used to build up the bottom surface and cannot be adjusted without having to chisel way all the filler material. An optimization of such a construction with minor changes of the position of the bottom surface and/or shape requires substantial input of work and costs.

The invention relates to both a method for converting an up-flow tower that has a conical inlet part to a down-flow tower and the down-flow tower itself.

DETAILED DESCRIPTION OF PREFERRED EMBODIMENTS

Figure 1:
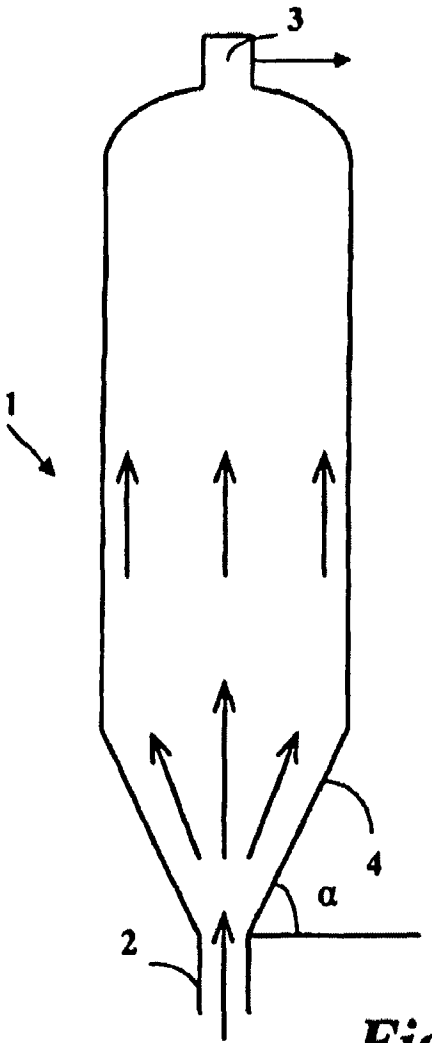
Fig.1 PRIOR ART
FIG. 1, shows a conventional up-flow tower where the inlet part of the tower with is conical inlet part is especially adapted to establish an even flow across the entire cross-section of the tower.

In FIG. 1 a conventional vertically standing up-flow tower 1 is shown that is used for storing and treating cellulose pulp with a medium consistency in the range of 8-16%. The up-flow tower 1 has an inlet 2 at the bottom of the tower that is transitioned to a conical inlet part 4 at the bottom of the tower. The conical inlet part has a cone angle $\alpha$ relative to the horizontal plane in the order of 30-80°, preferably 45-60°. The tower has an outlet 3 at the top of the tower.

Figure 2:
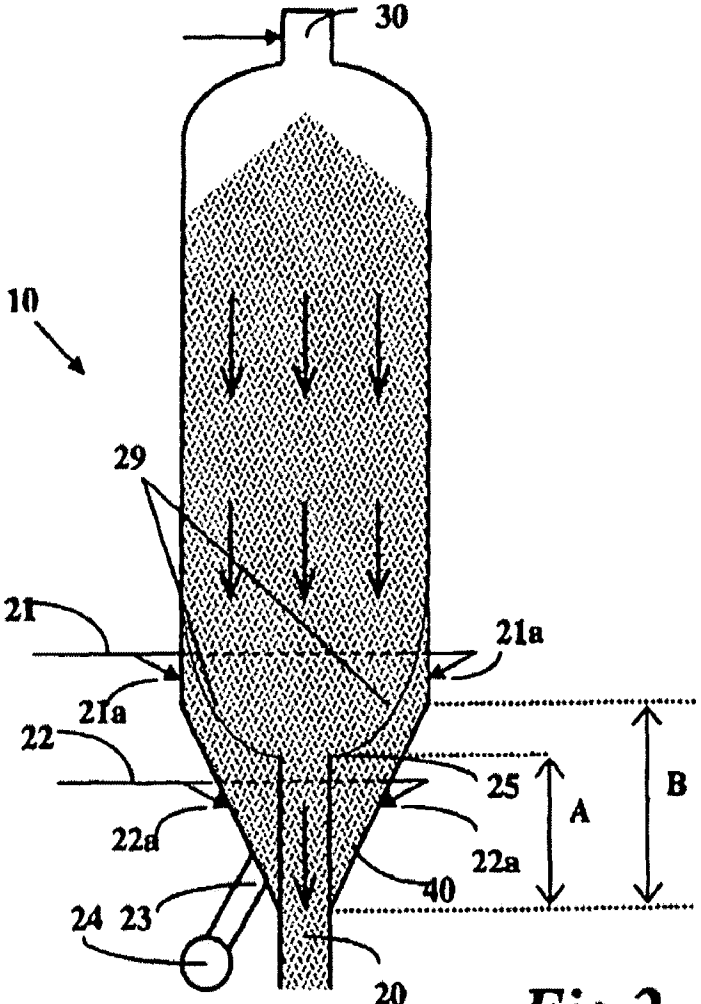
FIG. 2, shows a tower according to FIG. 1 that is converted to a down-flow tower according to the invention.

FIG. 2 shows how this tower is converted to a down-flow tower 10 by, at the inlet part of the earlier tower, insert a freely insertable pipe 25 that has an upper open end disposed at a first distance A from the lower part of the conical inlet part. This first distance A is less than the total vertical length B of the conical inlet part so that the original inlet and outlet instead is used at the outlet 20 and inlet 30, respectively in a down-flow tower.

By this design the cellulose pulp will establish a self-forming stagnation zone around the pipe 25 and in the lower part of the whole of the down-flow tower that is shown with a faint line 29 that extends from the upper edge of the pipe 25 and up toward the cylindrical wall portion of the tower. This line 29 shows the border between a pulp volume that is substantially stationary (the volume that lies under the line 29) and the active operational volume of the tower where the flow is established. This stagnation zone can simply be minimized by pulling the pipe downwardly in small steps until plugging phenomena are established when the pipe may be pushed up a predetermined distance so that a certain margin against plugging can be established at the current consistency. If the bleach line for some reason is changed so that the consistency is changed the optimization of the position of the pipe may be simply accomplished by shifting it along its height. When the consistency is increased the pipe is normally raised a bit and when the consistency is lowered the pipe is lowered.

In the mentioned application area a minimized stagnation volume 40 is normally obtained if the pipe 24 is inserted into the conical part of the tower so that the first distance A is in the order of 50-85% of the second distance B. In this way, the border line (that is indicated in FIG. 2) between the stagnation volume and the active volume can be adjusted so that it as much as possible is close to the conical walls of the tower.

To make emptying of the tower easier a number of first nozzles 21*a* are arranged for adding dilution liquid, via the dilution liquid conduit 21, to the peripheral conduit of the tower. The peripheral conduit is arranged at a first level of the tower to end in the tower above the upper open end of the pipe 25. The first set of nozzles for dilution liquid is used for diluting the cellulose pulp in connection with normal operation or during emptying of the tower. These dilution nozzles can also be used if sudden plugging tendencies occur in the tower during normal operation. As a rule these dilution nozzles can be shut off, or only have a very limited continuous flow of add-on dilution liquid that is well under a 10% addition of dilution liquid, during normal operation.

In the situation when the entire tower is to be emptied a second outlet 23 is arranged in the lower conical part of the tower. This other outlet 23 in connected to the part of the volume of the tower that is radially outside the pipe 25 but furthest at the bottom of the conical lower part of the tower. A number of second nozzles 22*a* are suitably arranged and provided with dilution liquid from the conduit 22 for the addition of dilution liquid in the periphery of the tower. The peripheral conduit 22 is arranged at a second level of the tower to end in the tower below the upper open end of the pipe 25. The second set of nozzles for dilution liquid is used for diluting the cellulose pulp in connection with emptying of the tower.

The invention can within the scope of the patent claims be modified in a number of ways. For example, the second outlet 23 can be integrated with the outlet 20 where an axially shiftable sleeve can be arranged around the pipe 25 and during shifting a second outlet opening is revealed in the pipe 25. The pipe 25 can also be arranged as a telescopic pipe where this pipe total insertion into the tower is controlled by a servo-mechanism. This mechanism can either be manual or reconnected depending upon the detected flow parameters that are indicative of possible plugging tendencies.

The control of dilution liquid to the nozzles 21*a* can also be done by a connected control system that depends on the detected flow parameters in a corresponding way.

While the present invention has been described in accordance with preferred compositions and embodiments, it is to be understood that certain substitutions and alterations may be made thereto without departing from the spirit and scope of the following claims.

The invention claimed is:

1. A method for storing and treating cellulose pulp having a medium consistency in a range of 8-16% and for converting a vertically standing up-flow tower used for storage or treatment of the pulp, comprising: providing an up-flow tower having an inlet centrally defined therein at a bottom of the tower that is transitioned to a conical inlet part at the bottom of the tower, the tower having an outlet defined therein at a top of the tower, inserting a pipe into the inlet part of the tower, the pipe having an upper open end disposed a first distance (A) from a lower part of the conical inlet part, the first distance (A) being shorter than a total vertical extension (B) of the conical inlet part, feeding cellulose pulp in through the outlet and discharging the cellulose pulp through the inlet so that the up-flow tower is converted to a down-flow tower, and the cellulose pulp forming a stagnation zone around the pipe and in the whole of a lower part of the down-flow tower below the upper end of the pipe.

2. The method according to claim 1 wherein the pipe is inserted into the conical part of the tower so that the first distance (A) is about 50-85% of the second distance (B).

3. The method according to claim 2 wherein a number of first nozzles are arranged for adding a dilution liquid to a peripheral conduit of the tower at a first level and arranged to end in the tower above an upper open end of the pipe.

4. The method according to claim 3 wherein a number of second nozzles for adding dilution liquid are arranged in the peripheral conduit of the tower at a second level and arranged to end in the tower below an upper open end of the pipe.

5. The method according to claim 1 wherein the pipe is inserted into the conical part of the tower by pulling the pipe downwardly in small steps until plugging occurs and then pushing the pipe up a distance so that a margin against plugging can be established at the current consistency.

* * * * *